US011851985B1

(12) United States Patent
AlMatrodi

(10) Patent No.: US 11,851,985 B1
(45) Date of Patent: Dec. 26, 2023

(54) ELECTRIC SUBSURFACE SAFETY VALVE NIPPLE ASSEMBLY

(71) Applicant: Saudi Arabian Oil Company, Dhahran (SA)

(72) Inventor: AbdulMalek Sulaiman AlMatrodi, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/115,538

(22) Filed: Feb. 28, 2023

(51) Int. Cl.
*E21B 34/10* (2006.01)

(52) U.S. Cl.
CPC ..... *E21B 34/105* (2013.01); *E21B 2200/05* (2020.05)

(58) Field of Classification Search
CPC ..... E21B 34/105
See application file for complete search history.

(56) References Cited

U.S. PATENT DOCUMENTS 6,102,828 A * 8/2000 MacKenzie ..... E21B 34/16 475/263
6,619,388 B2 * 9/2003 Dietz ..... E21B 34/066 166/66
6,719,057 B2 * 4/2004 Johansen ..... E21B 34/04 166/97.1
7,967,074 B2 * 6/2011 Lake ..... E21B 34/066 251/30.01

FOREIGN PATENT DOCUMENTS

CA 2244942 2/2005

* cited by examiner

*Primary Examiner* — Matthew R Buck
(74) *Attorney, Agent, or Firm* — Fish & Richardson P.C.

(57) ABSTRACT

A downhole nipple assembly includes a main body with a central bore configured to receive a hydraulically operated wireline-retrievable subsurface safety valve (WLSSSV and a pressure chamber open to the central bore via a sidewall port. The pressure chamber is configured to receive a volume of wellbore fluid from the central bore via the sidewall port as the nipple assembly is disposed within the wellbore prior to receipt of the WLSSSV in the central bore, and such that the sidewall port is in fluid communication with a pressure inlet port of the WLSSSV is locked in the central bore. The nipple assembly also includes an electrically operated piston assembly comprising a motor operable to drive a piston in response to an electric signal, thereby decreasing the volume of the pressure chamber and generating an increase in hydraulic pressure of the wellbore fluid at the pressure inlet port of the WLSSSV.

20 Claims, 10 Drawing Sheets

ELECTRIC SUBSURFACE SAFETY VALVE NIPPLE ASSEMBLY

TECHNICAL FIELD

This disclosure relates generally to fluid flow control within a subterranean well and in particular, to subsurface safety valves located downhole within the subterranean well.

BACKGROUND

In hydrocarbon production, a wellbore is drilled into a hydrocarbon-rich geological formation. After the wellbore is partially or completely drilled, a completion system is installed to secure the wellbore in preparation for production or injection. The completion system can include casing cemented in the wellbore to help control the well and maintain well integrity, and a production tubing positioned within the casing through which oil, gas, or other produced fluids can flow from the producing formation to the surface.

A wireline-retrievable subsurface safety valve can be installed within a nipple assembly installed on the production tubing, some distance below the surface. The subsurface safety valve can be configured to close in the event of an emergency or other condition, thereby preventing flow of fluid though the production tubing.

SUMMARY

Certain aspects of the subject matter herein can be implemented as a well system. The system includes a production tubing string configured to be disposed within a wellbore at least partially filled with a wellbore fluid and a nipple assembly connected to the production tubing string. The nipple assembly includes a main body with a central bore configured to receive a hydraulically operated wireline-retrievable subsurface safety valve (WLSSSV and a pressure chamber open to the central bore via a sidewall port. The pressure chamber is thereby configured to receive a volume of wellbore fluid from the central bore via the sidewall port as the nipple assembly is disposed within the wellbore prior to receipt of the WLSSSV in the central bore. The nipple assembly configured such that the sidewall port is in fluid communication with a pressure inlet port of the WLSSSV when the WLSSSV is received and releasably locked in the central bore. The nipple assembly also includes an electrically operated piston assembly comprising a motor operable to drive a piston in response to an electric signal, thereby decreasing the volume of the pressure chamber and generating an increase in hydraulic pressure of the wellbore fluid at the pressure inlet port of the WLSSSV when the WLSSSV is releasably locked in the central bore. The system also includes an electric cable configured to convey the electric signal from a surface location to the motor.

An aspect combinable with any of the other aspects can include the following features. The WLSSSV can be configured to, when releasably locked in the central bore, switch, in response to a force resulting from the increase in a hydraulic pressure at the pressure inlet port overcoming a biasing force of a spring connected to a closure member of the WLSSV, from a closed state in which the closure member blocks fluid flow through the production tubing string to an open state in which the closure member does not block fluid flow through the production tubing string. A movement of the piston in response to an electric signal change can increase the volume in the pressure chamber, thereby causing a decrease in hydraulic pressure at the inlet port such that the biasing force of the spring drives the closure member of the WLSSSV from the open state to the closed state.

An aspect combinable with any of the other aspects can include the following features. The electric signal change can be a cessation of an electric current.

An aspect combinable with any of the other aspects can include the following features. The electric signal can be a first control signal and the electric signal change can be a receipt by the motor of a second control signal transmitted to the nipple assembly.

An aspect combinable with any of the other aspects can include the following features. The piston can be a cylindrical piston.

An aspect combinable with any of the other aspects can include the following features. The piston can be or can include a bellows.

Certain aspects of the subject matter herein can be implemented as a nipple assembly configured to be connected to a production tubing string disposed in a wellbore at least partially filled with a wellbore fluid. The nipple assembly includes a main body with a central bore configured to receive a hydraulically operated wireline-retrievable subsurface safety valve (WLSSSV) and a pressure chamber open to the central bore via a sidewall port. The pressure chamber is thereby configured to receive a volume of wellbore fluid from the central bore via the sidewall port as the nipple assembly is disposed within the wellbore prior to receipt of the WLSSSV in the central bore. The nipple assembly is configured such that the sidewall port is in fluid communication with a pressure inlet port of the WLSSSV when the WLSSSV is received and releasably locked in the central bore. The nipple assembly further includes an electrically operated piston assembly comprising a motor operable to drive a piston in response to an electric signal, thereby decreasing the volume of the pressure chamber and generating an increase in hydraulic pressure of the wellbore fluid at the pressure inlet port of the WLSSSV when the WLSSSV is releasably locked in the central bore.

An aspect combinable with any of the other aspects can include the following features. The WLSSSV can be configured to, when releasably locked in the central bore, switch, in response to a force resulting from the increase in a hydraulic pressure at the pressure inlet port overcoming a biasing force of a spring connected to a closure member of the WLSSV, from a closed state in which the closure member blocks fluid flow through the production tubing string to an open state in which the closure member does not block fluid flow through the production tubing string. A movement of the piston in response to an electric signal change can increase the volume in the pressure chamber, thereby causing a decrease in hydraulic pressure at the inlet port such that the biasing force of the spring drives the closure member of the WLSSSV from the open state to the closed state.

An aspect combinable with any of the other aspects can include the following features. The electric signal can be a first control signal and the electric signal change can be a receipt by the motor of a second control signal transmitted to the nipple assembly.

An aspect combinable with any of the other aspects can include the following features. The nipple assembly can be configured to be attached to an electric cable configured to convey the electric signal to the nipple assembly from a surface location.

Certain aspects of the subject matter herein can be implemented as a method. The method includes connecting a nipple assembly to a production tubing string. The nipple assembly includes a main body with a central bore configured to receive a hydraulically operated wireline-retrievable subsurface safety valve (WLSSSV), a pressure chamber open to the central bore via a sidewall port, and an electrically operated piston assembly comprising a motor operable to drive a piston in response to an electric signal, thereby decreasing a volume of the pressure chamber. The method further includes disposing in a wellbore the production tubing string with the nipple assembly attached thereto, thereby permitting wellbore fluid to enter the pressure chamber via the sidewall port. The method further includes, after the production string and nipple assembly are disposed in the wellbore, lowering the WLSSSV downhole such that the WLSSSV is received and releasably locked in the central bore and the sidewall port is in fluid communication with a pressure inlet port of the WLSSSV. The method further includes, after the WLSSSV is received and releasably locked in the central bore, transmitting the electric signal to the motor, thereby generating an increase in hydraulic pressure of the wellbore fluid at the pressure inlet port of the WLSSSV.

An aspect combinable with any of the other aspects can include the following features. The WLSSSV can switch, in response to a force resulting from the increase in a hydraulic pressure at the pressure inlet port overcoming a biasing force of a spring connected to a closure member of the WLSSV, from a closed state in which the closure member blocks fluid flow through the production tubing string to an open state in which the closure member does not block fluid flow through the production tubing string. A movement of the piston can be in response to an electric signal change increases the volume in the pressure chamber, thereby causing a decrease in hydraulic pressure at the inlet port such that the biasing force of the spring drives the closure member of the WLSSSV from the open state to the closed state.

An aspect combinable with any of the other aspects can include the following features. The electric signal change can be a cessation of electric current to the motor.

An aspect combinable with any of the other aspects can include the following features. The electric signal can be a first control signal and the electric signal change is receipt by the motor of a second control signal. The method can further include transmitting the second control signal to the motor.

An aspect combinable with any of the other aspects can include the following features. The piston can be a cylindrical piston.

An aspect combinable with any of the other aspects can include the following features. The piston can be or can include a bellows.

An aspect combinable with any of the other aspects can include the following features. The electric signal can be transmitted to the motor via an electric cable configured to convey the electric signal from a surface location.

DETAILED DESCRIPTION

Wireline-retrievable subsurface safety valves (SSSVs) installed within nipple assemblies on production tubing can provide a fail-safe mechanism for preventing fluid flow through the production tubing in the event of an emergency or other condition. The opening and closing of the valves can be controlled by the application and removal of hydraulic pressure carried from a surface facility through a hydraulic control line strapped to the external surface of the production tubing to the nipple, which is then conveyed to the valve therein. However, such hydraulic control lines can be fragile and prone to corrosion or leakage, resulting in premature valve closure or other potentially hazardous or undesirable conditions, decreasing operational efficiency, and increasing well cost.

In accordance with an embodiment of the present disclosure, an improved system and method for deploying and operating a wireline-retrievable SSSV is disclosed. In some embodiments, the system can include a nipple assembly connected to a production tubing string. The nipple assembly can include a main body with a central bore therethough, the central bore fluidically connected to the production tubing string and configured to receive a wireline-retrievable subsurface safety valve (WLSSSV). The system can include an electric actuator assembly configured to open the WLSSSV by mechanically generating an increase in hydraulic pressure in response to an electric signal conveyed from a surface location to the nipple assembly. In some embodiments, the hydraulic pressure that operates the WLSSV is from wellbore fluid that fills a pressure chamber within the nipple assembly as the nipple assembly and production tubing string are lowered downhole. In such embodiments, in other words, it is the wellbore fluid itself that provides the hydraulic pressure, rather than a hydraulic fluid conveyed downhole (via, for example, a hydraulic line conduit). Thus, in some embodiments, the nipple assembly of the present disclosure can provide for operation of a standard hydraulically actuated WLSSSV without the necessity of conveying a dedicated hydraulic fluid downhole to the nipple assembly to operate the WLSSSV. The method and system of the present disclosure can provide a simple and more efficient system that can minimize the risk of hydraulic line corrosion or leakage, thus reducing costs, reducing environmental and safety risks, and increasing production. Furthermore, proper downhole operation of the SSSV can be monitored and problems more easily and efficiently identified using embedded pressure sensors within the actuator assembly.

Figure 1:
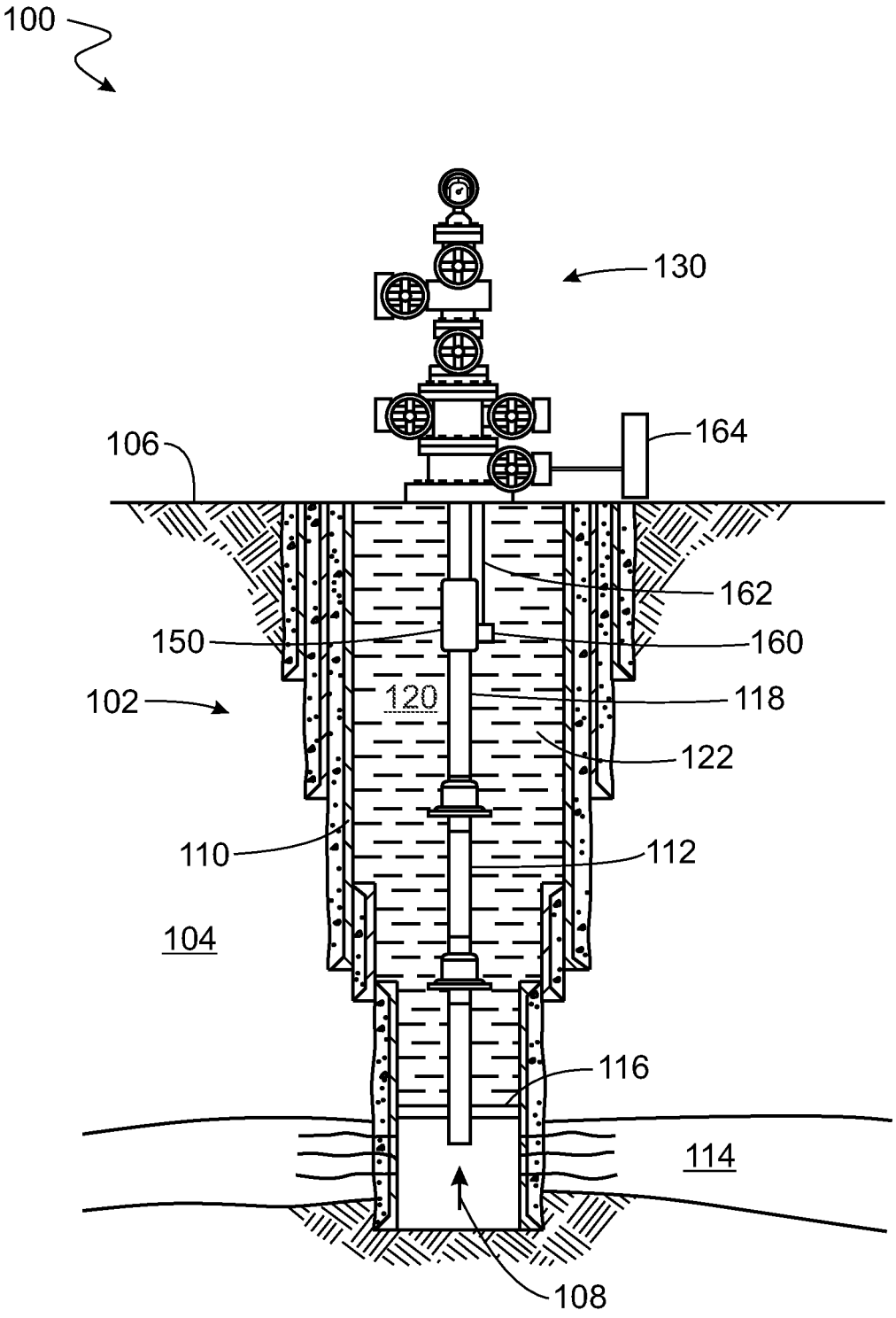
FIG. 1 is a schematic illustrations of a well system in accordance with an embodiment of the present disclosure.

FIG. 1 is a schematic illustrations of a well system in accordance with an embodiment of the present disclosure. Referring to FIG. 1, well system 100 includes a wellbore 102 drilled into a subterranean zone 104 from the Earth's surface 106. Casing string 110 is disposed within wellbore 102 and can include multiple nested casings of different diameters, and can be perforated (for example, proximate to its downhole end) so as to allow produced fluids to flow into the cased wellbore.

Production tubing string 112 is positioned within casing string 110 and provides a passageway through which produced fluid 108 from production zone 114 of subterranean zone 104 can reach the surface 106. A production packer 116 anchors and isolates the bottom of the production tubing string. When disposed in wellbore 102, production tubing string 112 can be partially or completely filled with wellbore fluid.

The inner surface of casing string 110 and the outer surface 118 of production tubing 112 define (or partially define) the tubing-casing annulus (TCA) 120. Wellbore fluid 122 fills or substantially fills the volume of the TCA 120 and the inner bore of production string 110. Wellbore fluid 122 can be or can include produced fluids 108 (produced from subterranean zone 104, such as oil, gas, and/or water), drilling fluids, completion fluids, or other fluids, and can include or can be a mixture of diesel, brine, or other fluid or particulate component. Well system 100 further includes a wellhead assembly 130 which can include hangers for casing string 110 and production tubing string 112 and can include various valves, spools, pressure gauges and chokes to regulate and control production of produced fluids 108 from wellbore 102. Produced fluids 108 can be flowed from wellhead assembly 130 via a production line (not shown) or other conveyance towards pipelines or other surface treatment, gathering, or conveyance facilities.

Well system 100 also includes a landing nipple assembly 150 connected to production tubing string 112, configured to receive and hold a WLSSSV. As described in greater detail below, the WLSSSV can include a closure member (such as a flapper or ball valve) that permits fluid flow through the central bore when in an open position (thus permitting fluid to flow in an uphole direction through production tubing 112) and that prevents fluid flow through the central bore when in a closed state (thus preventing fluid flow in an uphole direction through production tubing 112). Landing nipple assembly 150 is described in greater detail in reference to FIGS. 2A and 2B.

Nipple assembly 150 includes an actuator assembly 160 on or within landing nipple assembly 150 that includes electrical actuators configured to apply hydraulic pressure from wellbore fluids to operate the WLSSSV. Actuator assembly 160 is described in greater detail in reference to FIGS. 3A-3D. Well system 100 can further include an electric cable 162 which can be configured to supply an electric signal to and from actuator assembly 160 (and its components) to or from control module 164. In some embodiments the electric signal can include an electric current (or a termination (or other cessation) of an electric current), a control signal, a data signal, or another suitable electric signal, Control module 164 can in some embodiments include a surface panel or other output device for displaying pressure measurements and other information, and for sending electric signals to the sensor and actuators in actuator assembly 160.

In some embodiments, control module 164 is on a surface location at the wellsite proximate to wellhead assembly 130 and other wellsite equipment. In other embodiments, control module 164 can be remote from the wellsite and/or positioned at a subsurface or downhole location. In some embodiments, control module 164 can be part of and/or in communication with other remote or wellsite monitoring and control system such as a supervisory control and data acquisition (SCADA) system. In some embodiments, control module 164 is a portable system.

In some embodiments, control module 164 can be (or can include) a computer system that comprises one or more processors, and a computer-readable medium (for example, a non-transitory computer-readable medium) storing computer instructions executable by the one or more processors to perform operations that can include, for example, controlling actuator 160, monitoring hydraulic pressure applied to the WLSSSV, and others.

Figure 2A:
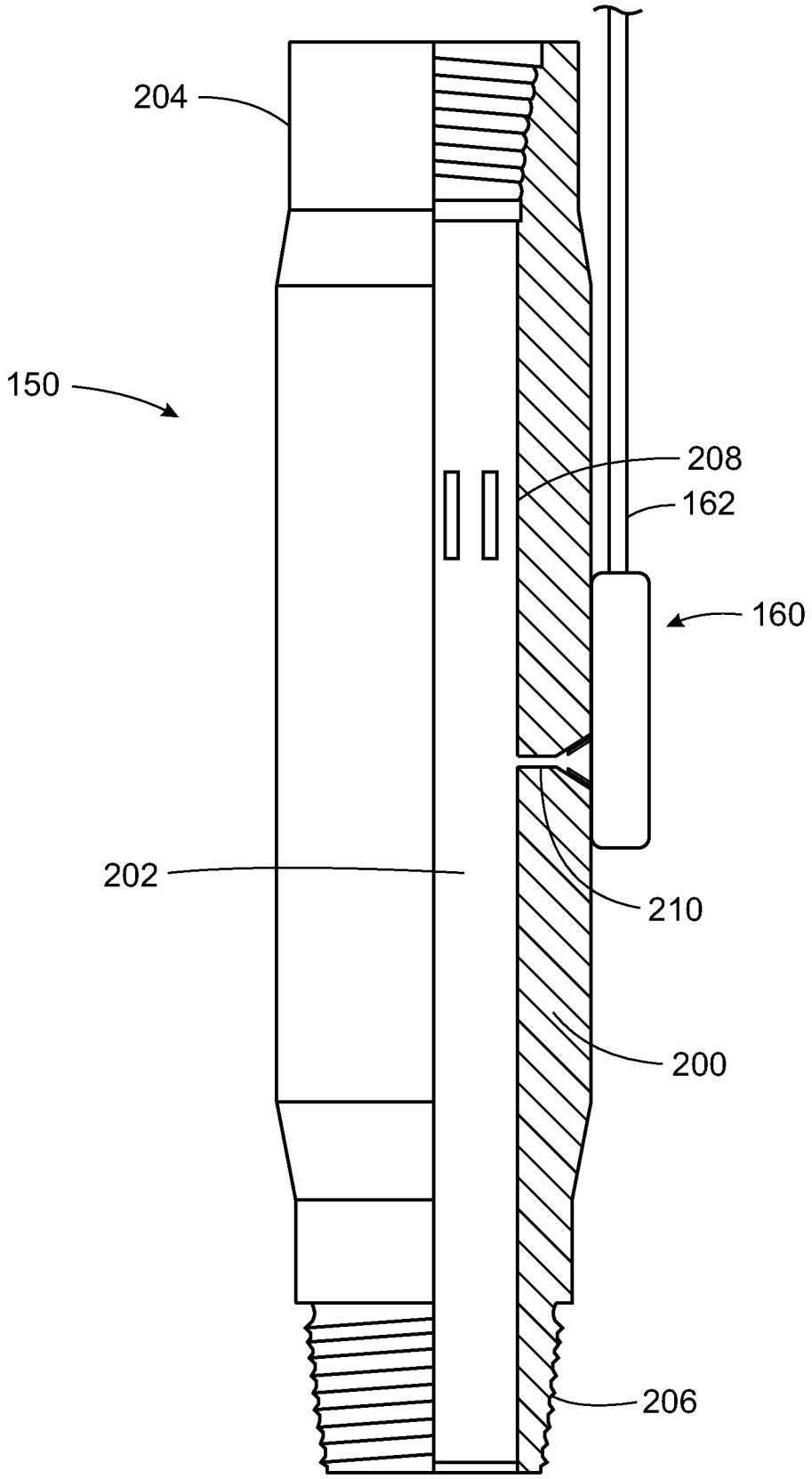
FIGS. 2A and 2B are schematic illustrations of a landing nipple assembly for a wireline-retrievable subsurface safety valve in accordance with an embodiment of the present disclosure.
Figure 2B:
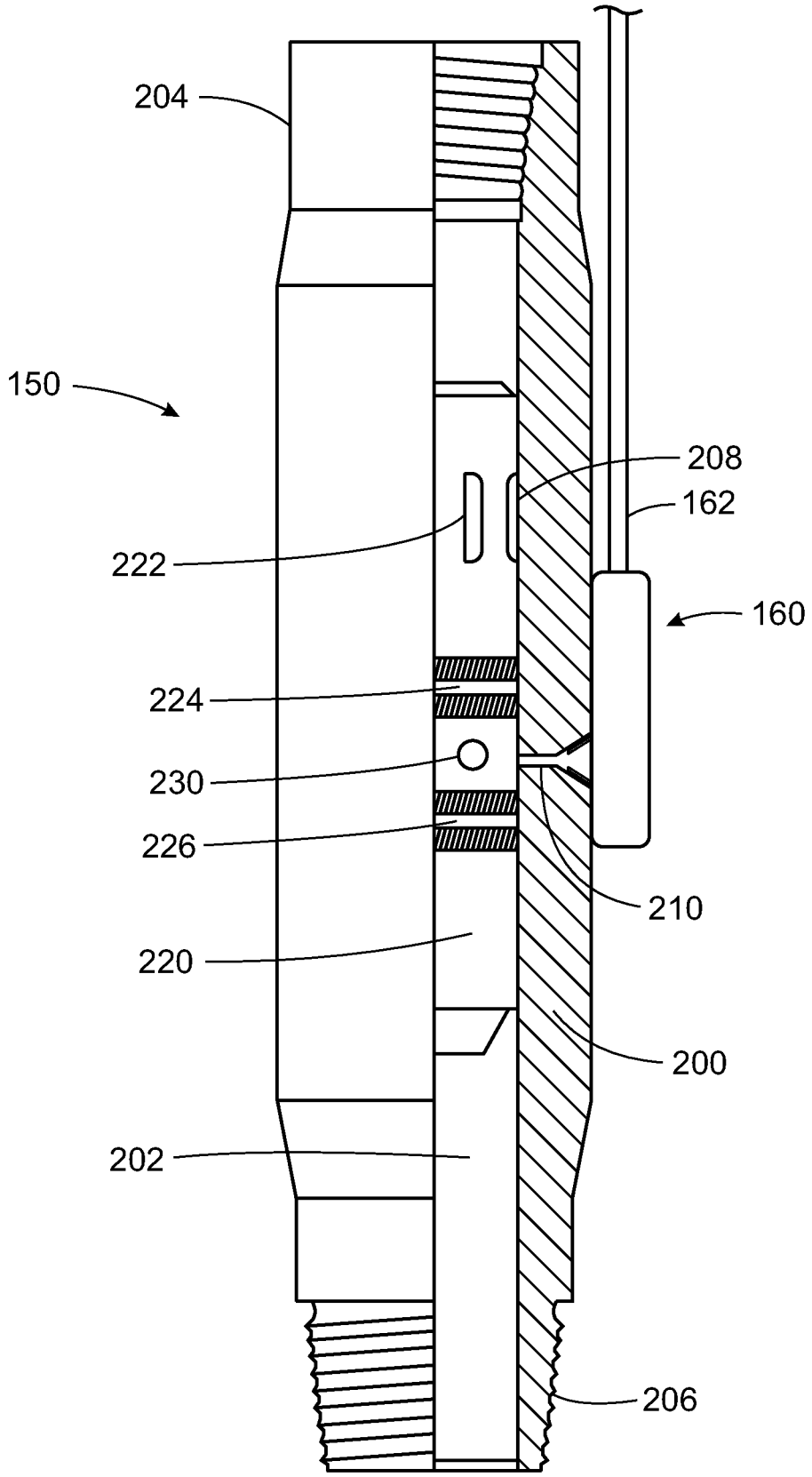

FIGS. 2A and 2B are schematic illustrations of nipple assembly 150 of FIG. 1 in accordance with some embodiments of the present disclosure. Referring to FIG. 2A, nipple assembly 150 includes a main body 200 with a central bore 202 in-line with the bore of the production tubing string. Upper threaded portion 204 provides a connection to the production tubing uphole of the nipple assembly, and lower threaded portion 206 provides a connection to the production tubing downhole of the nipple assembly. Central bore 202 is sized and configured to receive a WLSSSV, as described in greater detail below. Nipple profiles 208 are configured to engage with corresponding key profiles on the WLSSSV to releasably lock the WLSSSV within central bore 202. A sidewall port 210 fluidically connects a pressure chamber within actuator 160 (described in greater detail below) with central bore 202. In some embodiments, sidewall port 210 is open to central bore 202; that is, there is no burst disk or valve within or connected to sidewall port 210 that would prevent fluid flow into or out of central bore 202 via sidewall port 210. Thus, sidewall port 210 can in some embodiments provide a conduit through which the pressure chamber within actuator 160 can receive, and be at least partially filled by, a volume of wellbore fluid from central bore 202 as the nipple assembly is disposed within the wellbore, prior to receipt of the WLSSSV in central bore 202.

FIG. 2B illustrates nipple assembly 150 with WLSSSV 220 disposed therein, with key profiles 222 locked into nipple profiles 208 such that the pressure inlet 230 of WLSSSV 220 align with sidewall port 210 of nipple assembly 150 between upper seal element 224 and lower seal element 226, thus providing a sealed pathway for hydraulic pressure from actuator assembly 160 to be applied to the WLSSSV. As described in greater detail below with respect to an embodiment of the present disclosure, the WLSSSV is configured to—in response to an increase in a hydraulic pressure into the pressure inlet port—switch from a closed state in which fluid flow is blocked (not permitted) through the WLSSSV (and therefore through production tubing string) to an open state in which fluid flow is not blocked through the production tubing string and, in response to a removal or decrease in the hydraulic pressure at the pressure inlet port, switch back to the closed state. The switch from the closed state to the open state can be driven by the hydraulic pressure overcoming the force of a biasing spring connected to a closure member within in the WLSSSV configured to block flow through the WLSSSV, such that removal of the hydraulic pressure (either due to operator control or from an event such as equipment failure) allows the biasing force from the spring to force the valve back to the closed position. In this way, the WLSSSV system can be a component of a "fail-safe" system. In some embodiments, WLSSSV 220 can be a standard off-the-shelf hydraulically operated WLSSSV of the type available from Halliburton Energy Services, Inc., Schlumberger, Baker Hughes, and other providers. It will be understood that the WLSSSV in the present system and method can be wireline-retrievable in the sense that the valve can be conveyed downhole and disposed within the nipple assembly using a slickline or wireline conveyance; however, the term can also encompass valves conveyed downhole and disposed within the nipple assembly using other suitable conveyances (such as an autonomous robotic tractor).

It will be understood that actuator assembly 160 can be disposed on main body 200, which can include embodiments wherein actuator assembly 160 is disposed on an outer surface of nipple assembly 150 such that actuator assembly 160 protrudes from nipple assembly 150 into TCA 120 (as shown in FIGS. 1 and 2A-2B), and also embodiments wherein actuator assembly 160 is flush with the outer surface of nipple assembly 150 or embedded or enclosed within nipple assembly 150. In some embodiments, actuator assembly 160 is a modular unit that can easily be attached to or removed from an existing nipple assembly, such that no or little redesign or other alteration of a standard or off-the-shelf nipple assembly or WLSSSV is required and the actuator assembly can be easily transported to and installed on different nipple assemblies in different wells.

FIGS. 3A-3D are schematic illustrations of actuator assembly 160 of FIGS. 1 and 2A-2B in accordance with different embodiments of the present disclosure. The actuator assembly is referred to as actuator assembly 160*a* in the embodiment shown in FIGS. 3A-3B and as actuator assembly 160*b* in the embodiment shown in FIGS. 3C-3D. In either embodiment, the assemblies are configured to generate hydraulic pressure for opening a WLSSSV in response to an electric signal conveyed from a surface location to the nipple assembly via electric cable 162

Figure 3A:
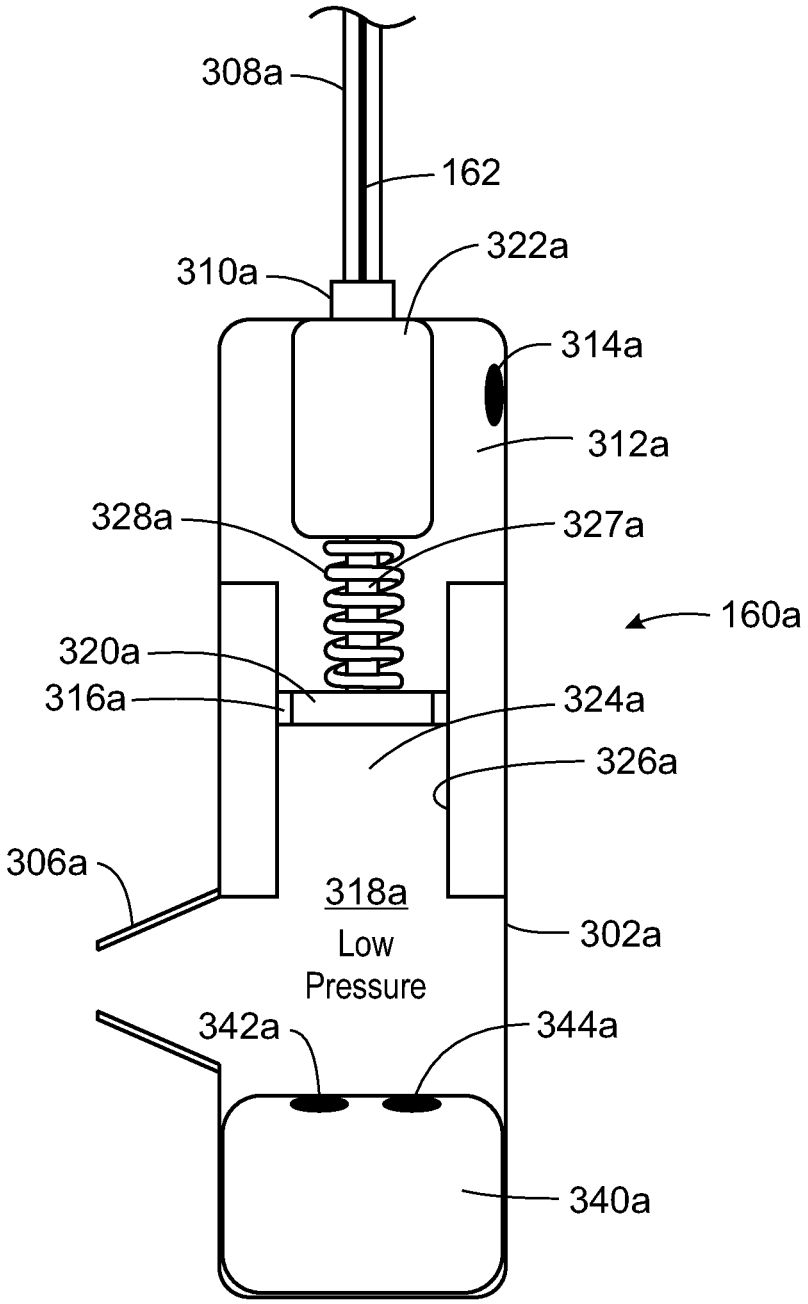
FIGS. 3A-3D are schematic illustrations of actuator assemblies in accordance with an embodiment of the present disclosure.

Referring to FIG. 3A, in the illustrated embodiment, actuator assembly 160*a* comprises a housing 302*a* and a pressure outlet 306*a*. Metallic tubing 308*a* and metal-to-metal seal 310*a* isolate and protect electric cable 162 from the potentially corrosive fluids in the tubing-casing annulus. Piston 320*a* is movable within polished bore 326*a*, and piston 320*a* and seals 316*a* isolate pressure in volume 312*a* from pressure chamber 318*a* on the other side the piston 320*a* from motor 322*a*. Motor 322*a* can be include a solenoid, geared motor, or other suitable motor, and is connected to piston 320*a* by shaft 327*a*. Pressure in volume 312*a* is equalized to the tubing-casing annulus via port 314*a*.

In the illustrated embodiment, pressure chamber 318*a* is open to the central bore 202 via sidewall port 210 (see FIGS. 2A and 2B). As described above, pressure chamber 318*a* is thus configured to receive a volume of wellbore fluid 324*a* from the central bore via the sidewall port as the nipple assembly is disposed within the wellbore (prior to receipt of the WLSSSV in the central bore). Likewise, the nipple assembly is configured such that the sidewall port is in fluid communication with the pressure inlet port of the WLSSSV when the WLSSSV is received and releasably locked in the central bore.

Figure 3B:
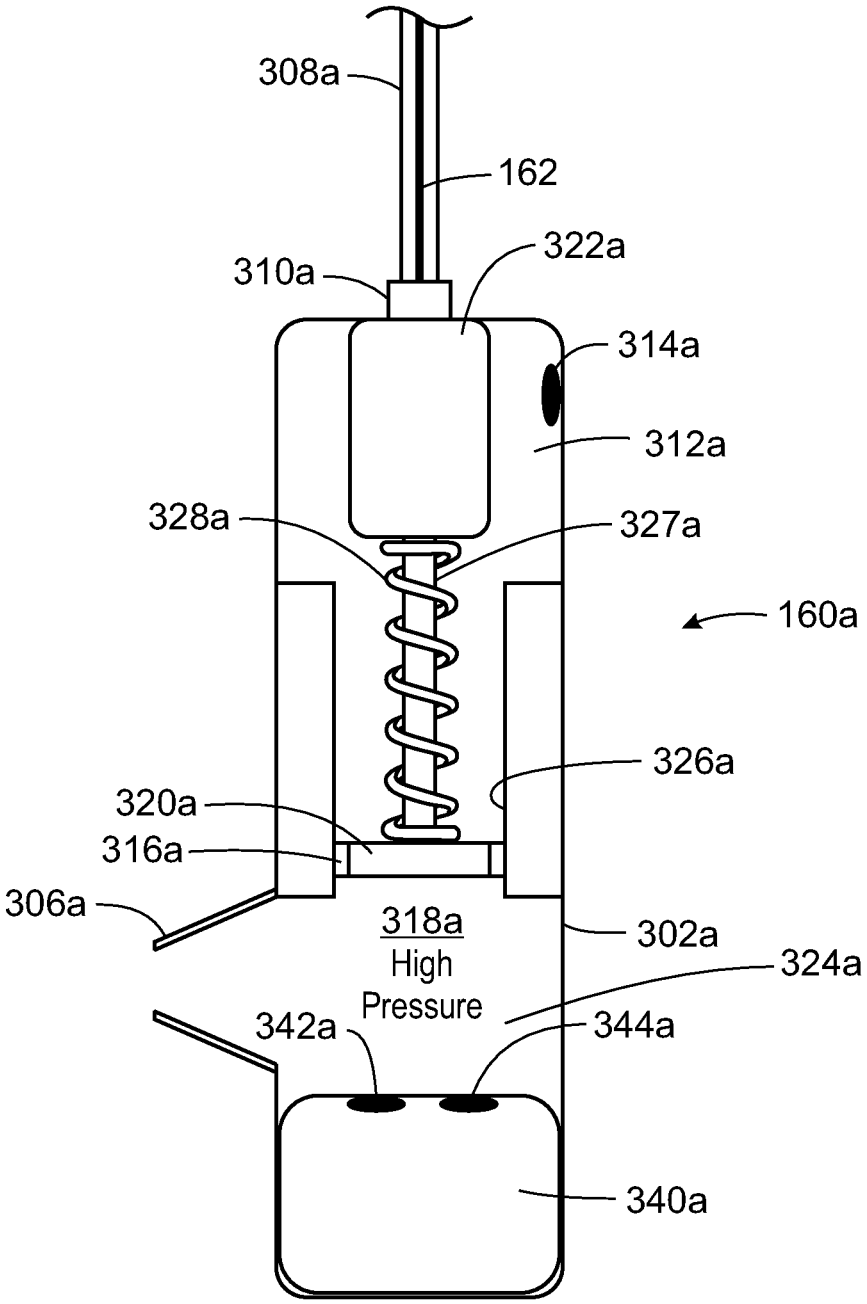

In the illustrated embodiment, piston 320*a* is a cylindrical piston. In response to an electric signal from electric cable 162, as shown in FIG. 3B, motor 322*a* drives piston 320*a* along polished bore 326*a*, decreasing the volume of pressure chamber 318*a* so as to drive fluid 324*a* at high pressure through pressure outlet 306*a*. With the WLSSV received and locked within the central bore, the pressure from pressure chamber 318*a* through pressure outlet 306*a* and sidewall port 210 through can increase the pressure of a pressure inlet port of the WLSSSV, which can generate a sufficient force (for example, mechanical force of a sliding sleeve of the WLSSSV driven by the hydraulic pressure) to cause the WLSSSV to switch to the open state (for example, as described in greater detail below, by overcoming a biasing force of a spring connected to as closure member of the WLSSSV). In some embodiments, the electric signal is electric current conveyed by electric cable 162 which actuates and powers to the motor. In some embodiments (for example, in which the actuator includes an internal battery to power the motor), the electric signal is a control signal conveyed by electric cable 162.

Because in some embodiments, as described above, the nipple assembly is configured such that pressure chamber 318*a* fills with wellbore fluid as the nipple assembly and production tubing string are lowered downhole, it is in such embodiments it is the wellbore fluid itself that provides the hydraulic pressure at the pressure inlet port of the WLSSSV. Thus, in some embodiments, the nipple assembly of the present disclosure can provide for operation of a standard hydraulically actuated WLSSSV without the necessity of conveying (whether via a hydraulic fluid conduit or within a volume carried within the nipple assembly) a dedicated hydraulic fluid downhole to the nipple assembly to operate the WLSSSV.

In some embodiments, a change in the electric signal can trigger or permit piston 320*a* to move in a direction that increases the volume in pressure chamber 318*a* and causing a decrease in hydraulic pressure at the inlet port, thus (for example) allowing the WLSSSV to switch back from the open state to the closed state. Such switch from the open state to the closed state can be, for example, movement of the closure member of the WLSSSV driven at least in part by the biasing force of the spring. In some embodiments, the electric signal change can be in the form of a partial or complete cessation of electric current, caused by (for example) a well control event or other trigger acting on (or damaging or destroying) the surface control module, such that the nipple assembly and WLSSSV are part of a "fail-safe" system, closing the production tubing string against fluid flow in the event of a catastrophic event or other circumstance in which well closure is desirable. In some embodiments, the electric signal change can be a second electric signal sent to the motor triggering the return piston movement (i.e., a second signal sent at an appropriate time after the (first) initial signal that opens the valve, when closure of the valve is necessary or desirable).

Spring 328*a* is connected to piston 320*a* and is pulled to an extended position as motor 322*a* drives piston 320*a*. The extension of spring 328*a* provides a biasing force such that, if the driving force from motor 322*a* is reduced or is eliminated (for example, in response to the electric signal change described above), the biasing force of spring 328*a* pulls piston 320*a* back to the starting position, thus reducing or eliminating the hydraulic pressure applied through pressure outlet 306*a*.

Actuator assembly 160*a* further includes a sensor module 340*a* including a pressure sensor 342*a* whereby pressure in pressure chamber 318*a* can be monitored to ensure proper operation of actuator 160*a* and the WLSSSV system. (for example, by indicating to the operator whether sufficient pressure is being generated by actuator assembly 160*a* to open the WLSSSV, and/or whether a decrease in pressure is sufficient to cause closure of the WLSSSV). In some embodiments, actuator assembly can also include other suitable sensors such as temperature sensor 344*a*.

Figure 3C:
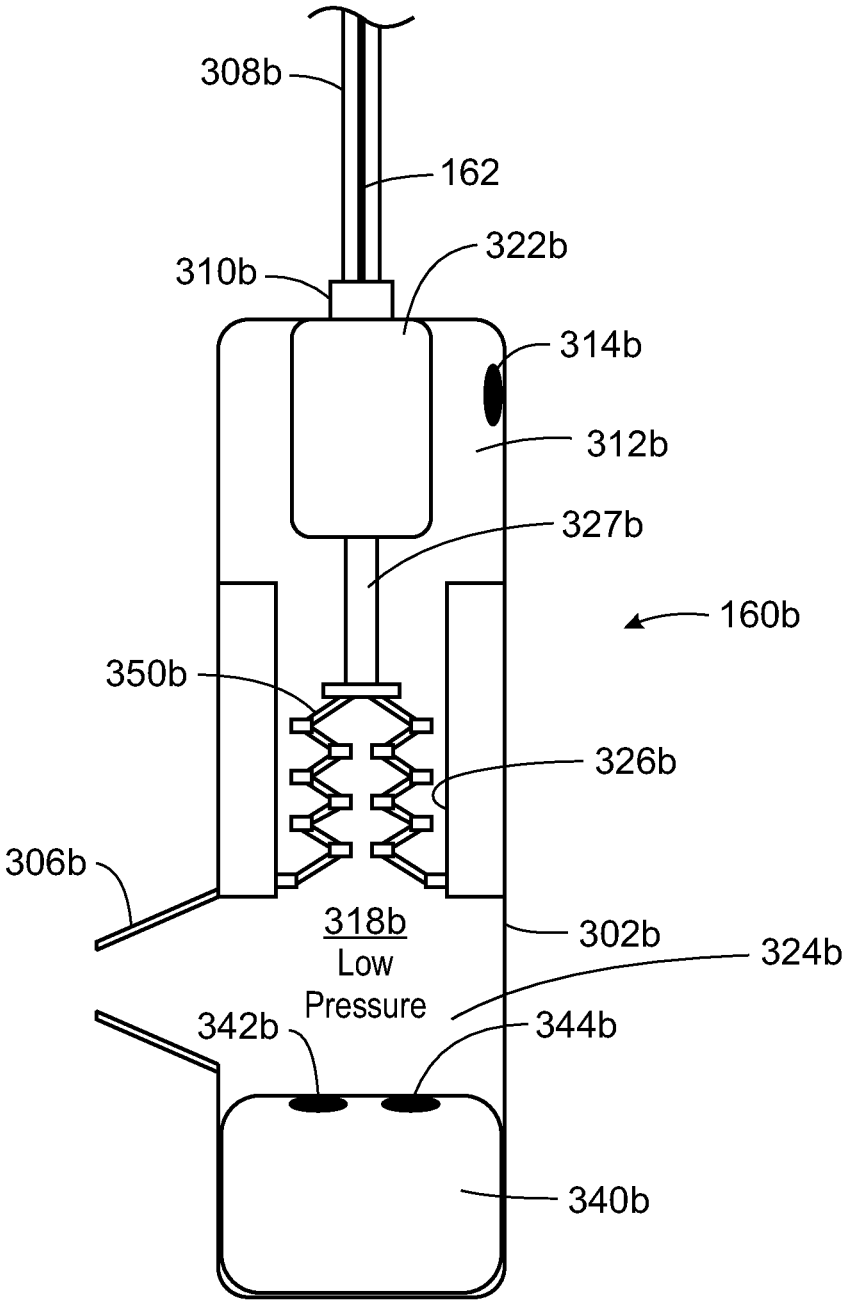
Figure 3D:
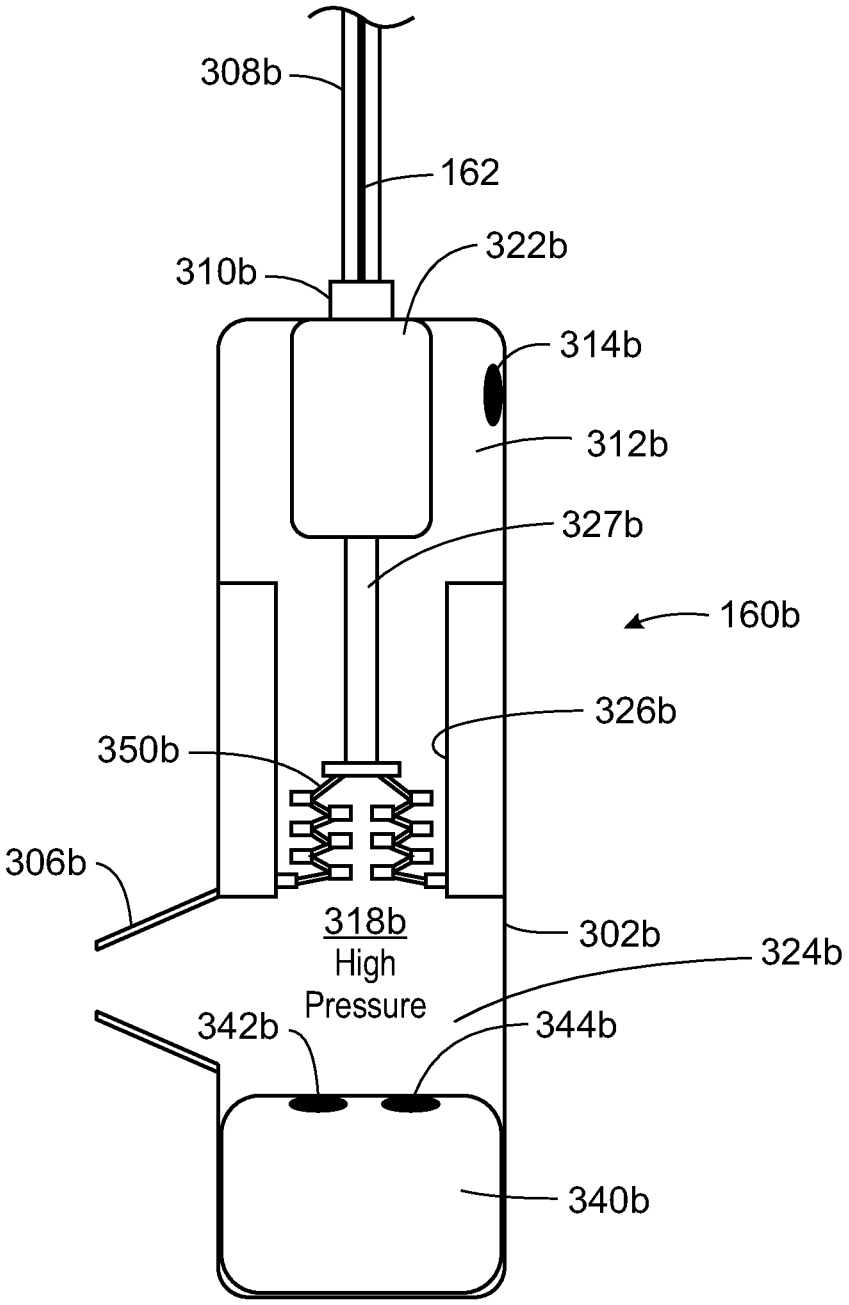

FIGS. 3C and 3D illustrate an embodiment in which the piston comprises a bellows instead of the cylindrical piston and spring included in the embodiment of FIGS. 3A and 3B. Referring to FIG. 3C, and similar to the embodiment shown in FIGS. 3A and 3B actuator assembly 160*b* comprises a housing 302*b* and a pressure outlet 306*b*. Metallic tubing 308*b* and metal-to-metal seal 310*b* isolate and protect electric cable 162 from the potentially corrosive fluids in the tubing-casing annulus. Pressure in volume 312*b* is equalized to the tubing-casing annulus via port 314*b*. Bellows 350*b* isolates pressure in volume 312*b* from volume 318*b* on the other side bellows 350*b* from motor 322. Bellows 350*b* can be made of a flexible metallic material or other suitable flexible material. Motor 322*b* can be include a solenoid, geared motor, or other suitable motor, and drives bellows 350*b* to compress fluid 324*b* that fills volume 318*b*.

In response to an electric signal from cable 162, as shown in FIG. 3D, motor 322*b* compresses bellows 350*b*, driving fluid 324*b* at high pressure through pressure outlet 306*b*. The compression of fluid 324*b* in turn provides a biasing force such that, if the driving force from motor 322*b* is reduced or is eliminated (for example, in response to an electric signal change as described above), bellows 350*b* unfolds back to the starting position, thus reducing or eliminating the hydraulic pressure applied through pressure outlet 306*b*.

Similar to actuator assembly 160*a* of FIGS. 3A and 3B, actuator assembly 160*b* further includes a sensor module 340*b* including a pressure sensor 342*b* whereby pressure in volume 318*b* can be monitored to ensure proper operation of actuator 160*b* and the WLSSSV system. In some embodiments, actuator assembly can also include other suitable sensors such as temperature sensor 344*b*.

Figure 4:
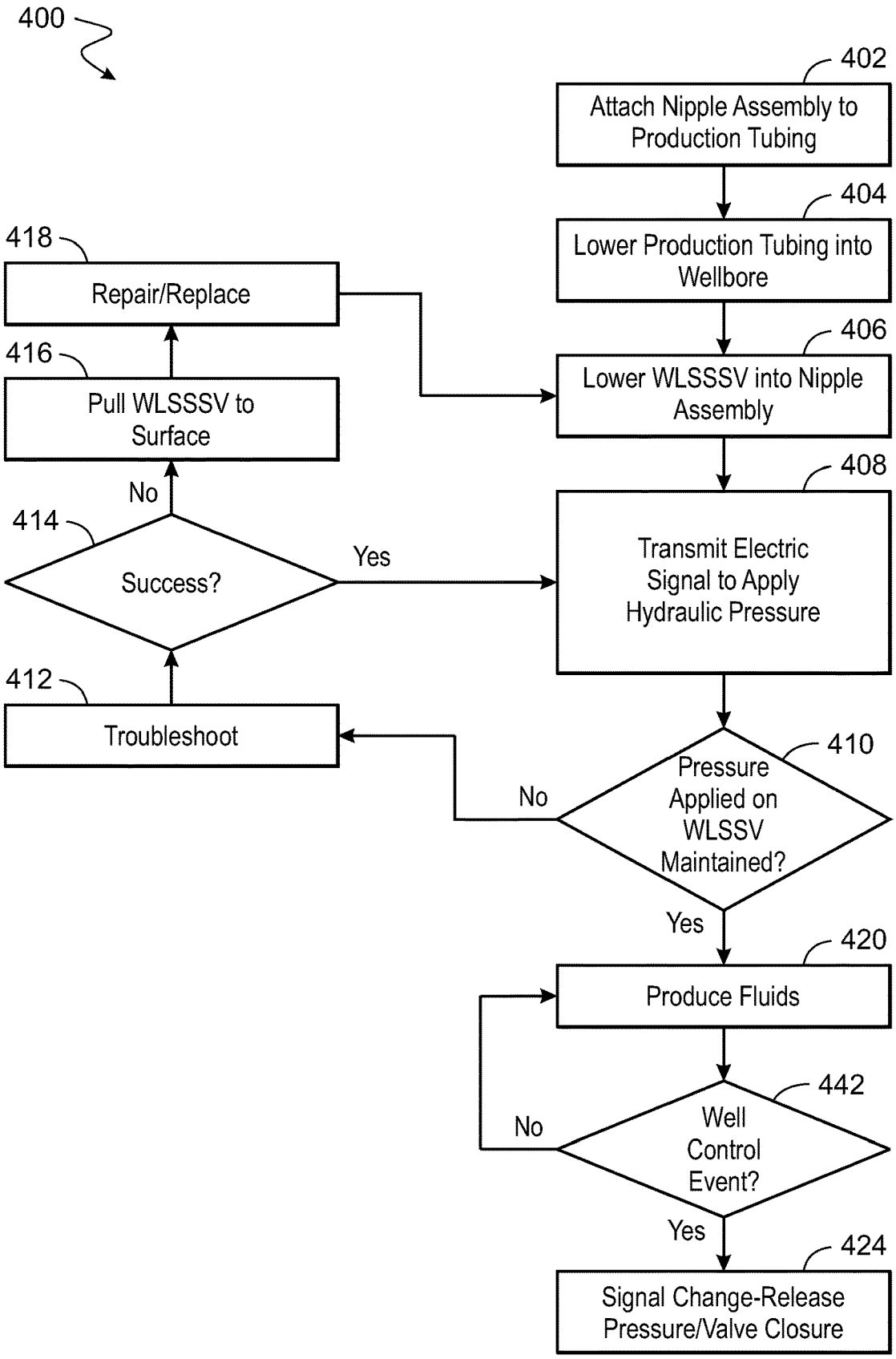
FIG. 4 is a process flow diagram of operating a well system with a wireline-retrievable subsurface safety valve in accordance with an embodiment of the present disclosure.

FIG. 4 is a process flow diagram of a method 400 of determining a change in a position of the closure member of a subsurface safety valve in accordance with an embodiment of the present disclosure. Method 400 will be described in reference to system 100 described in reference to the above figures. The method begins at step 402 in which nipple assembly 150 is attached to production tubing 112 at a surface location. The method then proceeds to step 404 in which production tubing 112, with nipple assembly 150 attached, is lowered into the wellbore. As described above, in some embodiments, as the nipple assembly proceeds downhole, wellbore fluid can enter the pressure chamber of an actuator within or attached to the nipple assembly via a sidewall port open to a central bore of the nipple assembly.

As step 406, after the production string and nipple assembly are disposed in the wellbore, a WLSSSV is lowered downhole such that the WLSSSV is received and releasably locked in the central bore and the sidewall port is in fluid communication with a pressure inlet port of the WLSSSV.

At step 408, the operator transmits an electric signal to actuator assembly 160 that triggers the application of hydraulic pressure of the wellbore from the actuator assembly into the pressure inlet port of the WLSSSV, as described above and as illustrated in FIG. 5A (which illustrates an embodiment in which WLSSSV 220 is a flapper-type valve including a flapper 502). Wellbore fluid from pressure outlet 306 of actuator assembly 160 can apply pressure on chamber 506 at sufficient hydraulic pressure to overcome the biasing force of spring 508 to move sliding sleeve 504 and thereby move flapper 502 to the open position.

At step 410, the operator can use pressure readings from the pressure sensor within the actuator assembly to confirm whether the pressure applied to the WLSSSV is being maintained, thus confirming proper valve opening. If at step 410 the sensor readings indicate that pressure is not being maintained as expected, then at step 412 troubleshooting operations can commence. If at step 414 the troubleshooting operations are successful, then the method can return to step 408 for additional pressure testing. If at step 414 the troubleshooting is not successful, then the WLSSSV can at step 416 be pulled from the nipple and at step 418 repaired or replaced, thus returning to step 406.

Returning to step 410, if the pressure readings are maintained indicating proper valve opening, then, at step 420, production fluid (such as water, oil, and/or gas) can flow through the production tubing. The valve can remain open and production can continue so long as no well control event or other event or circumstance in which valve closure is necessary or desired occurs (shown as the return arrow at step 442).

Figure 5A:
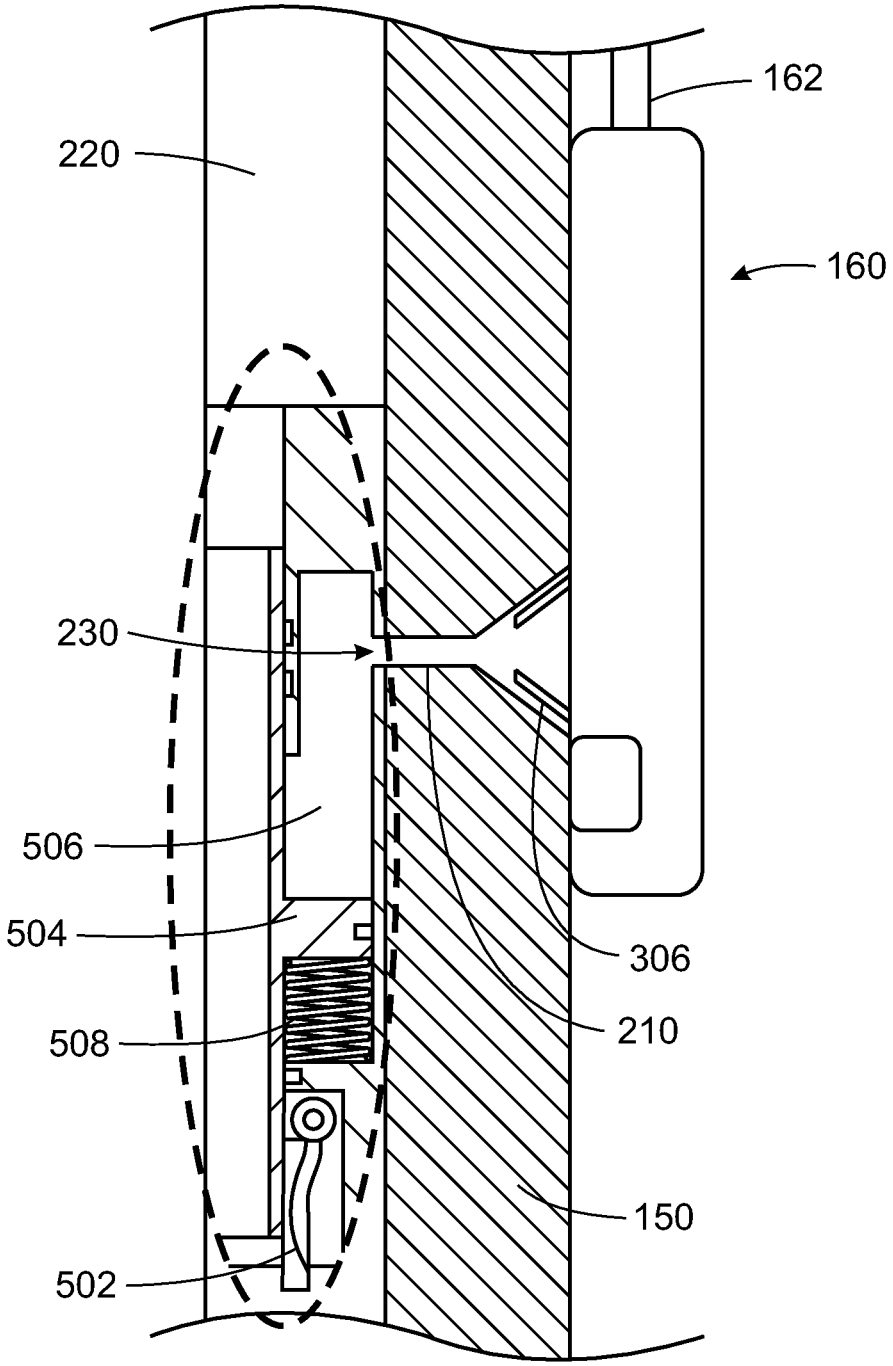
FIGS. 5A and 5B are schematic illustrations of operation of a subsurface safety valve and landing nipple assembly in accordance with an embodiment of the present disclosure.
Figure 5B:
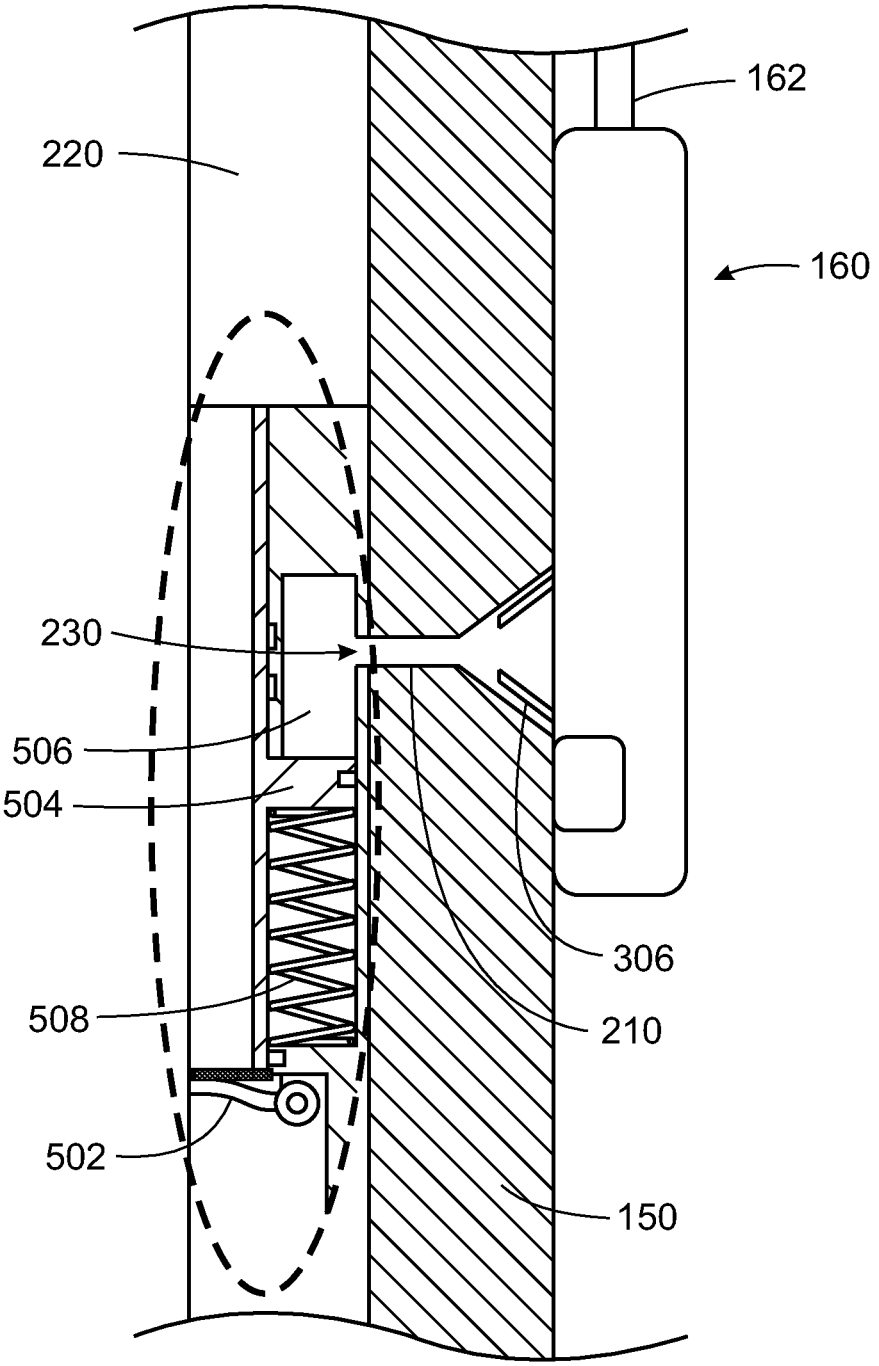

If at step 442 a well control event or other event or circumstance in which valve closure is necessary or desired occurs, then the method proceeds to step 424 in which the electric an electric signal change (such as a cessation of an electric current or a control signal) initiates a decrease in the pressure applied to the WLSSSV, triggering its closure. Such closure is illustrated in FIG. 5A, in which fluid from pressure outlet 306 of actuator assembly 160 is sufficiently reduced such that the biasing force of spring 508 moves sliding sleeve 504 and thereby causing flapper 502 to move to the closed position such that fluid can no longer flow through the production tubing.

The term "uphole" as used herein means in the direction along the production tubing or the wellbore from its distal end towards the surface, and "downhole" as used herein means the direction along a tubing string or the wellbore from the surface towards its distal end. A downhole location means a location along the tubing string or wellbore downhole of the surface.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A well system comprising:

a production tubing string configured to be disposed within a wellbore at least partially filled with a wellbore fluid;

a nipple assembly connected to the production tubing string, the nipple assembly comprising;

a main body with a central bore configured to receive a hydraulically operated wireline-retrievable subsurface safety valve (WLSSSV);

a pressure chamber open to the central bore via a sidewall port, the pressure chamber thereby configured to receive a volume of wellbore fluid from the central bore via the sidewall port as the nipple assembly is disposed within the wellbore prior to receipt of the WLSSSV in the central bore, wherein the nipple assembly configured such that the sidewall port is in fluid communication with a pressure inlet port of the WLSSSV when the WLSSSV is received and releasably locked in the central bore;

an electrically operated piston assembly comprising a motor operable to drive a piston in response to an electric signal, thereby decreasing the volume of the pressure chamber and generating an increase in hydraulic pressure of the wellbore fluid at the pressure inlet port of the WLSSSV when the WLSSSV is releasably locked in the central bore; and an electric cable configured to convey the electric signal from a surface location to the motor.

2. The well system of claim 1, wherein:

the WLSSSV is configured to, when releasably locked in the central bore, switch, in response to a force resulting from the increase in a hydraulic pressure at the pressure inlet port overcoming a biasing force of a spring connected to a closure member of the WLSSV, from a closed state in which the closure member blocks fluid flow through the production tubing string to an open state in which the closure member does not block fluid flow through the production tubing string; and a movement of the piston in response to an electric signal change increases the volume in the pressure chamber, thereby causing a decrease in hydraulic pressure at the inlet port such that the biasing force of the spring drives the closure member of the WLSSSV from the open state to the closed state.

3. The well system of claim 2, wherein the electric signal change is a cessation of an electric current.

4. The well system of claim 1, wherein the electric signal is a first control signal and the electric signal change is a receipt by the motor of a second control signal transmitted to the nipple assembly.

5. The well system of claim 1, wherein the piston comprises a cylindrical piston.

6. The well system of claim 1, wherein the piston comprises a bellows.

7. A nipple assembly configured to be connected to a production tubing string disposed in a wellbore at least partially filled with a wellbore fluid, the nipple assembly comprising:

a main body with a central bore configured to receive a hydraulically operated wireline-retrievable subsurface safety valve (WLSSSV);

a pressure chamber open to the central bore via a sidewall port, the pressure chamber thereby configured to receive a volume of wellbore fluid from the central bore via the sidewall port as the nipple assembly is disposed within the wellbore prior to receipt of the WLSSSV in the central bore, wherein the nipple assembly configured such that the sidewall port is in fluid communication with a pressure inlet port of the WLSSSV when the WLSSSV is received and releasably locked in the central bore; and an electrically operated piston assembly comprising a motor operable to drive a piston in response to an electric signal, thereby decreasing the volume of the pressure chamber and generating an increase in hydraulic pressure of the wellbore fluid at the pressure inlet port of the WLSSSV when the WLSSSV is releasably locked in the central bore.

8. The nipple assembly of claim 7, wherein:

the WLSSSV is configured to, when releasably locked in the central bore, switch, in response to a force resulting from the increase in a hydraulic pressure at the pressure inlet port overcoming a biasing force of a spring connected to a closure member of the WLSSV, from a closed state in which the closure member blocks fluid flow through the production tubing string to an open state in which the closure member does not block fluid flow through the production tubing string; and a movement of the piston in response to an electric signal change increases the volume in the pressure chamber, thereby causing a decrease in hydraulic pressure at the inlet port such that the biasing force of the spring drives the closure member of the WLSSSV from the open state to the closed state.

9. The nipple assembly of claim 8, wherein the electric signal change is a cessation of an electric current.

10. The nipple assembly of claim 8, wherein the electric signal is a first control signal and the electric signal change is a receipt by the motor of a second control signal transmitted to the nipple assembly.

11. The nipple assembly of claim 7, wherein the piston comprises a cylindrical piston.

12. The nipple assembly of claim 7, wherein the piston comprises a bellows.

13. The nipple assembly of claim 7, wherein the nipple assembly is configured to be attached to an electric cable configured to convey the electric signal from a surface location to the motor.

14. A method comprising:

connecting a nipple assembly to a production tubing string, the nipple assembly comprising:

a main body with a central bore configured to receive a hydraulically operated wireline-retrievable subsurface safety valve (WLSSSV);

a pressure chamber open to the central bore via a sidewall port; and an electrically operated piston assembly comprising a motor operable to drive a piston in response to an electric signal, thereby decreasing a volume of the pressure chamber;

disposing in a wellbore the production tubing string with the nipple assembly attached thereto, thereby permitting wellbore fluid to enter the pressure chamber via the sidewall port;

after the production tubing string and the nipple assembly are disposed in the wellbore, lowering the WLSSSV downhole such that the WLSSSV is received and releasably locked in the central bore and the sidewall port is in fluid communication with a pressure inlet port of the WLSSSV;

after the WLSSSV is received and releasably locked in the central bore, transmitting the electric signal to the motor, thereby generating an increase in hydraulic pressure of the wellbore fluid at the pressure inlet port of the WLSSSV.

15. The method of claim 14, wherein the WLSSSV switches, in response to a force resulting from the increase in a hydraulic pressure at the pressure inlet port overcoming a biasing force of a spring connected to a closure member of the WLSSV, from a closed state in which the closure member blocks fluid flow through the production tubing string to an open state in which the closure member does not block fluid flow through the production tubing string; and wherein a movement of the piston in response to an electric signal change increases the volume in the pressure chamber, thereby causing a decrease in hydraulic pressure at the inlet port such that the biasing force of the spring drives the closure member of the WLSSSV from the open state to the closed state.

16. The method of claim 15, wherein the electric signal change is a cessation of electric current to the motor.

17. The method of claim 15, wherein the electric signal is a first control signal and the electric signal change is receipt by the motor of a second control signal, and further comprising transmitting the second control signal to the motor.

18. The method of claim 14, wherein the piston comprises a cylindrical piston.

19. The method of claim 14, wherein the piston comprises a bellows.

20. The method of claim 14, wherein the electric signal is transmitted to the motor via an electric cable configured to convey the electric signal from a surface location.

* * * * *